US008312654B2

(12) United States Patent
Chang et al.

(10) Patent No.: US 8,312,654 B2
(45) Date of Patent: Nov. 20, 2012

(54) KEY TAG

(75) Inventors: Wei-Yu Chang, New Taipei (TW); Wei-Chih Chang, New Taipei (TW)

(73) Assignee: Shyh Ru Metallic Industrial Corp., New Taipei (TW)

( * ) Notice: Subject to any disclaimer, the term of this patent is extended or adjusted under 35 U.S.C. 154(b) by 12 days.

(21) Appl. No.: 13/206,616

(22) Filed: Aug. 10, 2011

(65) Prior Publication Data

US 2012/0042550 A1 Feb. 23, 2012

Related U.S. Application Data

(60) Provisional application No. 61/376,222, filed on Aug. 23, 2010.

(51) Int. Cl.
*G09F 3/20* (2006.01)

(52) U.S. Cl. ..... 40/634; 40/6

(58) Field of Classification Search ..... 40/6, 330, 40/634

See application file for complete search history.

(56) References Cited

U.S. PATENT DOCUMENTS

| | | | | | |
|---|---|---|---|---|---|
| 1,505,838 | A * | 8/1924 | Withrow | 40/634 |
| 2,213,075 | A * | 8/1940 | Ross | 40/634 |
| 2,540,718 | A * | 2/1951 | Duskin | 40/651 |
| 4,521,981 | A * | 6/1985 | Kasprzycki et al. | 40/634 |
| 5,075,991 | A * | 12/1991 | Wenkman et al. | 40/781 |
| 5,183,153 | A * | 2/1993 | Linn | 206/232 |
| 5,193,297 | A * | 3/1993 | De Fex et al. | 40/5 |
| 6,351,903 | B1 * | 3/2002 | Tuomi | 40/634 |
| 6,543,161 | B2 * | 4/2003 | Chin | 40/6 |
| 6,782,998 | B2 * | 8/2004 | Koren | 206/39 |
| 2004/0148837 | A1 * | 8/2004 | Lewis | 40/654.01 |

* cited by examiner

*Primary Examiner* — Casandra Davis
(74) *Attorney, Agent, or Firm* — WPAT PC; Justin King

(57) ABSTRACT

A key tag includes: a body having a recess and a through hole near its one end, a tag sheet accommodated in the recess, and a cover sheet adaptively engaged with the body so as to confine the tag sheet within the recess.

7 Claims, 2 Drawing Sheets

KEY TAG

FIELD OF THE INVENTION

The present invention relates to a key identification apparatus, and more particularly, to a key tag.

BACKGROUND OF THE INVENTION

A conventional key tag, generally made by plastic, leather or a metallic material in single-piece structure, allows a user to label with text or symbols thereon with a marker for identification purposes. However, such key tag is usually good for one-time use only. Further, the text or symbols labeled on the conventional key tag are prone to disengagement due to exposure to external abrasions such that the originally intended identification function may be lost.

SUMMARY OF THE INVENTION

It is an objective of the present disclosure to provide a key tag that allows a user to change a tag sheet thereof for repeated use.

It is another objective of the present invention to provide a key tag in which a cover sheet and a body are adaptively engaged to protect a tag sheet thereof from external abrasions, thereby maintaining its identification function intact.

To achieve the objectives above, a key tag according to the present invention comprises: a body, having a recess and a through hole near its one end; a tag sheet received in the recess; and a cover sheet adaptively engaged with the body so as to confine the tag sheet within the recess.

According to the key tag of the present invention, the key tag further comprises an opening penetrating through the recess.

According to the key tag of the present invention, the through hole of the key tag is provided with a connecting ring for interlinking with a key ring.

According to the key tag of the present invention, the body of the key tag further comprises another through hole near the other end of the body.

According to the key tag of the present invention, the key tag further comprises a ring portion extended from an end portion of the body to form the another through hole.

According to the present invention, the cover sheet of the key tag is made of a transparent material.

According to the present invention, the cover sheet of the key tag is made of a partial transparent material.

Furthermore, a key tag according to the present invention comprises: a body, having a recess and a projecting portion provided in a projecting manner at a surface of the body, wherein the projecting portion is provided with a through hole; a tag sheet received in the recess; and a cover sheet adaptively engaged with the body so as to confine the tag sheet within the recess.

According to the key tag of the present invention, the key tag further comprises an opening penetrating through the recess.

According to the key tag of the present invention, the through hole of the key tag is provided with a connecting ring for interlinking with a key ring.

According to the key tag of the present invention, the body of the key tag further comprises another through hole near one end of the body.

According to the key tag of the present invention, the key tag further comprises a ring portion extended from an end portion of the body to form the another through hole.

According to the present invention, the cover sheet of the key tag is made of a transparent material.

According to the present invention, the cover sheet of the key tag is made of a partial transparent material.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION OF THE PREFERRED EMBODIMENT

Figure 1:
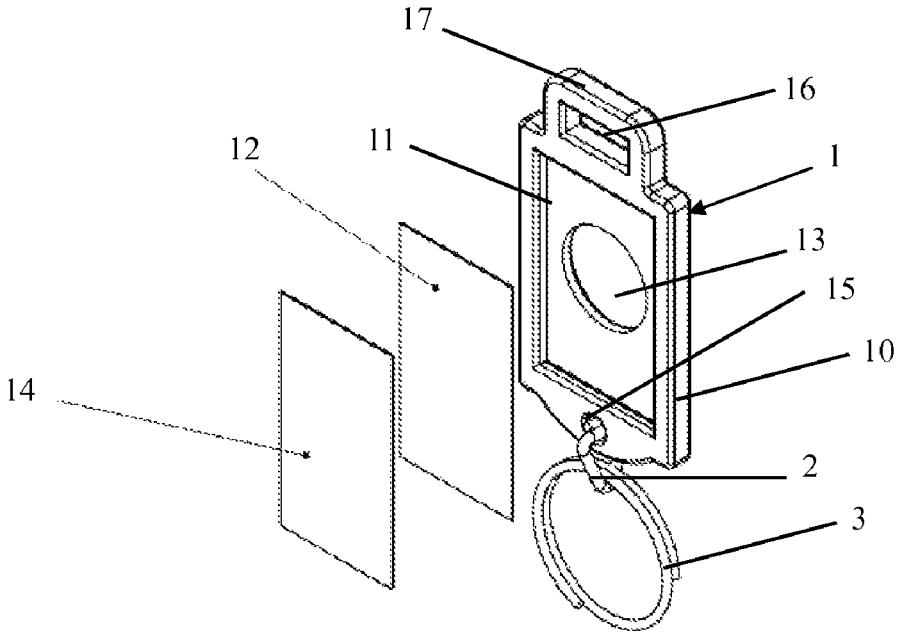
FIG. 1 is an elevational view of a key tag according to a preferred embodiment of the present invention.

FIG. 1 shows an elevational view of a key tag according to a preferred embodiment of the present invention. As shown in FIG. 1, a key tag 1 comprises a body 10, a tag sheet 12 and a cover sheet 14. The body 10 comprises a recess 11 for accommodating the tag sheet 12. By adaptively engaging the cover sheet 14 and the body 10, the tag sheet 12 is confined in the recess 11. The cover sheet 14 and the recess 11 are of a same or similar shape and area size in order to cooperate with each other. In this embodiment, the cover sheet 14 and the recess 11 are both rectangular. However, it is apparent to a person skilled in the art that, any shape or pattern is suitable as long as the cover sheet 14 and the recess 11 can be adaptively engaged.

To allow a user to label the tag sheet 12 with text or symbols, the tag sheet 12 may be made of paper, plastic, acrylic, metal, wood and bamboo, preferably a material that allows adhesion of an ink thereon. Since the cover sheet 14 is capable of protecting the tag sheet 12 from external abrasions, a drawback associated with the prior art that the conventional tag being prone to disengagement due to external abrasions is entirely prevented. Preferably, the cover sheet 14 is made of transparent or partial transparent material to facilitate a user to identify text or symbols on the tag sheet 12.

Further, an opening 13 is provided at the recess 11 of the body 10 to penetrate through the recess 11. When the cover sheet 14 is engaged with the body 10, in the event that a user wishes to change the tag sheet 12 or modify text or symbols on the tag sheet 12, the user may press through the opening 13 to disengage the cover sheet 14 from the body 10. Thus, the user is enabled to modify text or symbols on the tag sheet 12 or directly replace an original tag sheet 12 with a new one.

Further, the body 10 is respectively provided with a first through hole and a second through hole at two ends thereof. The first through hole 15 is provided with a connecting ring 2 for interlinking with a key ring 3, which further interlinks with a key (not shown in the drawing). Similarly, the key ring 3 may also be directly interlinked with the first through hole 15.

According to the embodiment, the second through hole 16 is formed by a ring portion 17 extending from one end of the body 10. The second through hole 16 is for placing the key tag 1 to a fixed hook.

Figure 2:
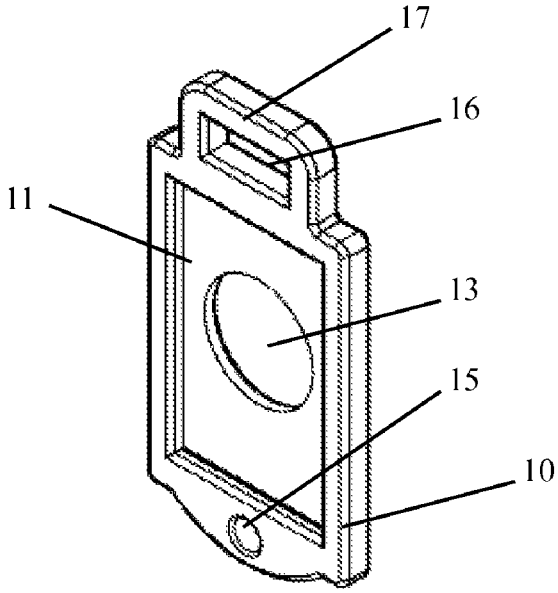
FIG. 2 is a front elevational view of the body 10 in FIG. 1.
Figure 3:
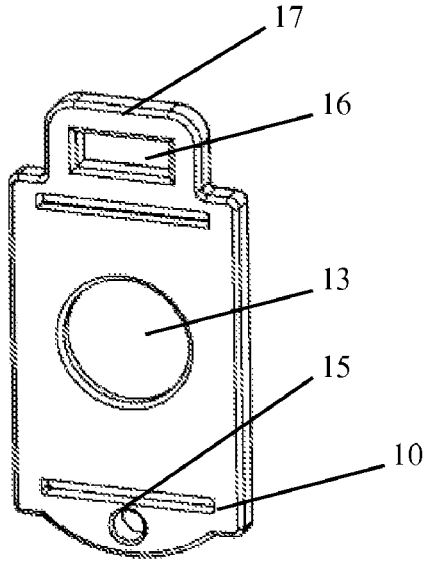
FIG. 3 is a rear elevational view of the body 10 in FIG. 1.

FIG. 2 shows a front elevational view of the body 10, whereas FIG. 3 shows a rear elevational view of the body 10.

Figure 4:
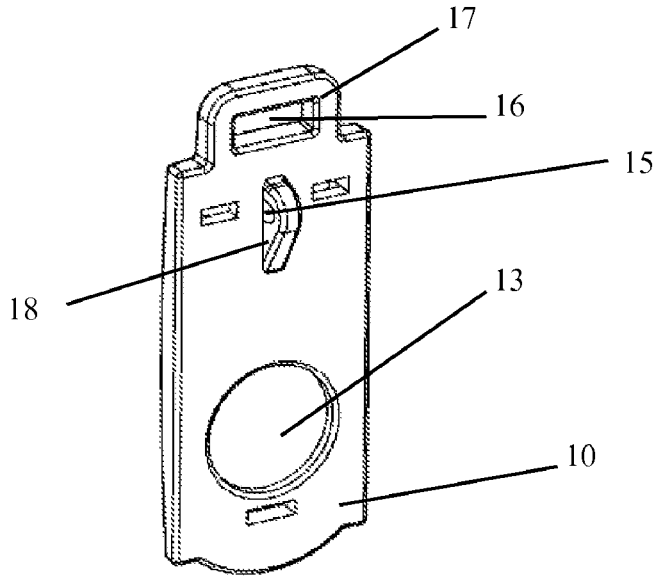
FIG. 4 is a rear elevational view of a key tag according to another preferred embodiment of the present invention.

FIG. 4 shows a rear elevational view of a key tag according to a preferred embodiment of the present invention. A main difference between the embodiment in FIG. 4 and that in FIGS. 1 to 3 is that, a rear side of the body 10 according to the embodiment in FIG. 4 comprises a projecting portion 18. In other words, the projecting portion 18 is projected on the rear side of the body 10, while the first through hole 15 of this embodiment is provided on the projecting portion 18. As described previously, the first through hole 15 is provided with a connecting ring 2 for interlinking with a key ring 3, which further interlinks with a key. Similarly, the key ring 3 may also be directly interlinked with the first through hole 15.

With description of the embodiments, it is illustrated that a user is allowed to change the tag sheet 12 as desired for repeated use. Further, by adaptively engaging the cover sheet 14 and the body 10, the tag sheet 12 is protected from external abrasions to keep its identification function intact.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A key tag, comprising:

a body, comprising a recess, and a projecting portion provided in a projecting manner at a surface of the body, wherein the projecting portion positioned opposite to the recess and is provided with a first through hole;

a tag sheet, accommodated in the recess of the body; and a cover, for forcefully confining the tag sheet in the recess when adaptively engaged with the body.

2. The key tag according to claim 1, further comprising an opening penetrating through the recess.

3. The key tag according to claim 1, wherein the first through hole is provided with a connecting ring for interlinking with a key ring.

4. The key tag according to claim 1, further comprising a second through hole provided at one end of the body.

5. The key tag according to claim 4, further comprising a ring portion extended form an end portion of the body to form the first through hole.

6. The key tag according to claim 1, wherein the cover is made of a transparent material.

7. The key tag according to claim 1, wherein the cover is made of a partial transparent material.

* * * * *